United States Patent [19]

Hammermann

[11] Patent Number: 4,625,667

[45] Date of Patent: Dec. 2, 1986

[54] SEWING MACHINE WITH A STEP MOTOR FOR FEED CONTROL

[75] Inventor: Joachim Hammermann, Karlsruhe-Durlach, Fed. Rep. of Germany

[73] Assignee: Pfaff Haushaltmaschinen GmbH, Fed. Rep. of Germany

[21] Appl. No.: 615,458

[22] Filed: May 30, 1984

[30] Foreign Application Priority Data

Jun. 11, 1983 [DE] Fed. Rep. of Germany ..... 3321215

[51] Int. Cl.[4] ..... D05B 3/02

[52] U.S. Cl. ..... 112/456; 318/685; 318/696

[58] Field of Search ..... 112/456, 453, 455, 121.12, 112/121.11, 314; 318/685, 696

[56] References Cited

U.S. PATENT DOCUMENTS 4,191,120 3/1980 Bergvall ..... 112/158 E 4,271,773 6/1981 Makabe et al. ..... 112/158 E 4,404,509 9/1983 Hartwig ..... 112/121.12 X 4,413,577 11/1983 Minalga et al. ..... 112/158 E

*Primary Examiner*—Peter Nerbun

*Attorney, Agent, or Firm*—McGlew and Tuttle

[57] ABSTRACT

In a sewing machine with a microcomputer controlled step motor for the control of the magnitude and direction of the feeding action of a cloth feeder, the microcomputer is connected, via a buffer and a D/A converter, to the non-inverting input of a comparator which controls the turn-on and turn-off as well as the current intensity of each phase winding of the step motor and whose inverting input is connected to a discriminating element disposed in the phase circuit, for the step setting correction and for the torque intensification of the step motor. To adapt the correction possibilities to the step motor parameters, the D/A converter has four input stages whose biggest stage is connected to the corresponding output stage of the buffer via a voltage divider.

5 Claims, 6 Drawing Figures

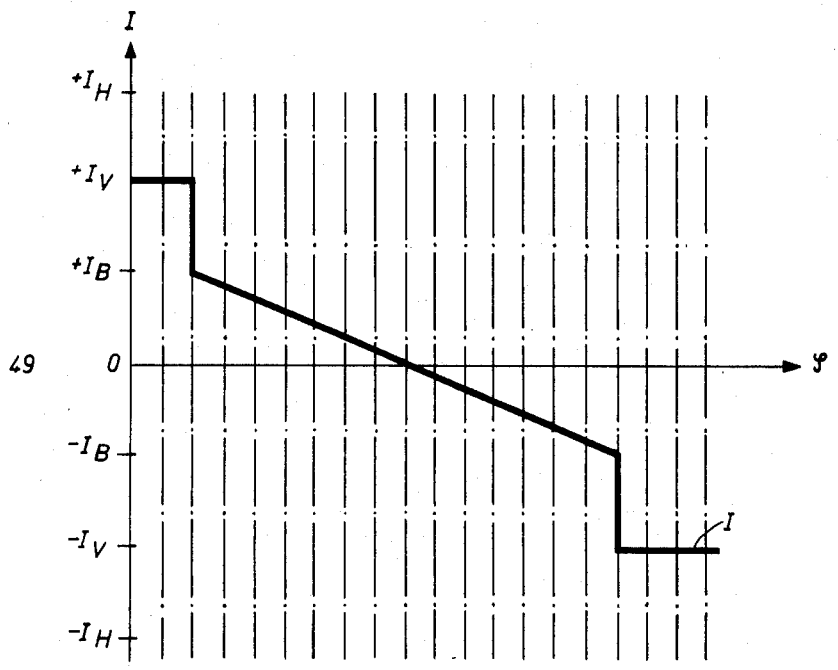
Fig.6
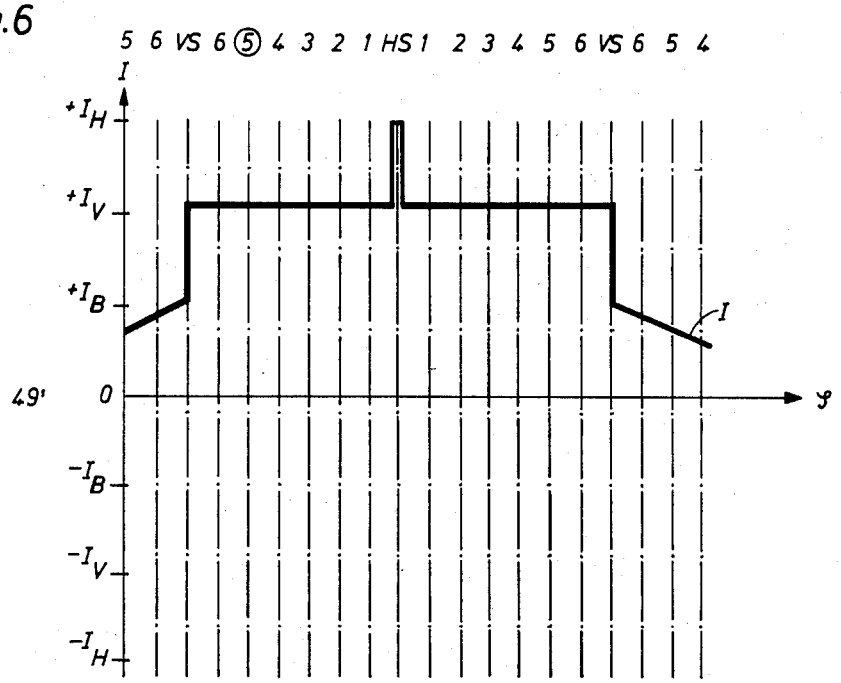

SEWING MACHINE WITH A STEP MOTOR FOR FEED CONTROL

FIELD AND BACKGROUND OF THE INVENTION

The present invention relates in general to sewing machines and in particular to a new and useful controlling mechanism for the step motor of a sewing machine which utilizes stored digital information to produce different stitch patterns.

Electronically controlled sewing machines preferably have step motor drives to control the alteration of the lateral swing-out motion of the needle bar and the feeding motion of the cloth feeder because such drives are excellently suited for the conversion of the digitally stored stitch information. The transmission ratio between the step size of the step motor and the respectively driven element must be selected so that, at a fine enough gradation of the adjusting motion, the adjustment of the driven element within the maximum adjustment range can be made fast enough within the time available. However, under certain conditions the existing gradation from step to step is insufficient. A further division is then necessary.

In one known sewing machine (U.S. Pat. No. 4,191,120), the step setting of the step motor to alter the transport motion of the sewing machine can be corrected manually. This is done by energizing the two phase windings of the step motor differently by means of two potentiometers. Due to this measure, the adjustment of the cloth feed control element can be divided further within the minimum feed range. Due to the better fine adjustment of the control element, better sewing results can be obtained, especially when feeding steps near the zero transport range are made for both forward and backward sewing. The differences resulting in this range between forward and backward feeding, depend upon the type of material to be sewn and upon the operating mode of the cloth feeder so that adjustability must be provided if the quality of the sewing work to be performed is not to suffer. This difference also depends on the exact factory-set step setting of the step motion of the zero transport position of the control element.

Such a correction is especially necessary when sewing patterns are involved which contain a multiplicity of stitches to be made in the one as well as in the other transport direction. In such cases, every feeding difference between the two transport directions, not recognizable in individual stitches, shows as cumulative error which can make the sewing result useless.

The above mentioned known sewing machine solves the problem only very imperfectly because the fine adjustment is restricted only to the minimum feed range of the sewing machine. When set to longer stitch lengths, a correction for the exact execution of forward and backward stitches of the same size is not possible.

SUMMARY OF THE INVENTION

It is an object of the present invention to make the step setting correction possible over the entire step range of the step motor and to combine it with the step motor control. Accordingly an object of the present invention is to provide a sewing machine which has a main shaft, a vertically guided needle bar in driving connection with the main shaft for a lifting motion of the needle bar, a step motor with a plurality of phase windings that can be controlled by a microcomputer connected to setting means for the control of the size and direction of the feeding action of the cloth feeder, and a pulse generator connected to the main shaft and triggering the step motor motion, wherein the microcomputer is connected to a digital-to-analog converter over a buffer memory, and to the non-inverting input of a comparator which controls the turning on and the turning off as well as the intensity of a phase current for each phase winding of the step motor and whose inverting input is connected to a discriminating element disposed in a phase circuit of the step motor for controlling the step motor.

According to the invention, a step motor control for a sewing machine is provided which not only permits the execution of a correction by finely graduated stages of the step position that is preset by the step motor in a simple maner, but in addition also makes possible an intensification of the driving torque of the step motor and of the holding moment in certain holding positions of the step motor. Moreover, a different correction in different situations can be preset in a simple manner through a microcomputer.

A special adaptation for the correction to the parameters of the step motor design results from the use of an D/A converter.

A further object of the invention is to provide a sewing machine with a circuit for controlling a step motor which controls the movement of either the needle bar, the cloth feeder or both, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

One embodiment of the invention is depicted in the drawings wherein:

FIG. 6 shows phase current curves of both step motor phase windings in successive correction positions correlated as to time.

DESCRIPTION OF THE PREFERRED EMBODIMENT

Figure 1:
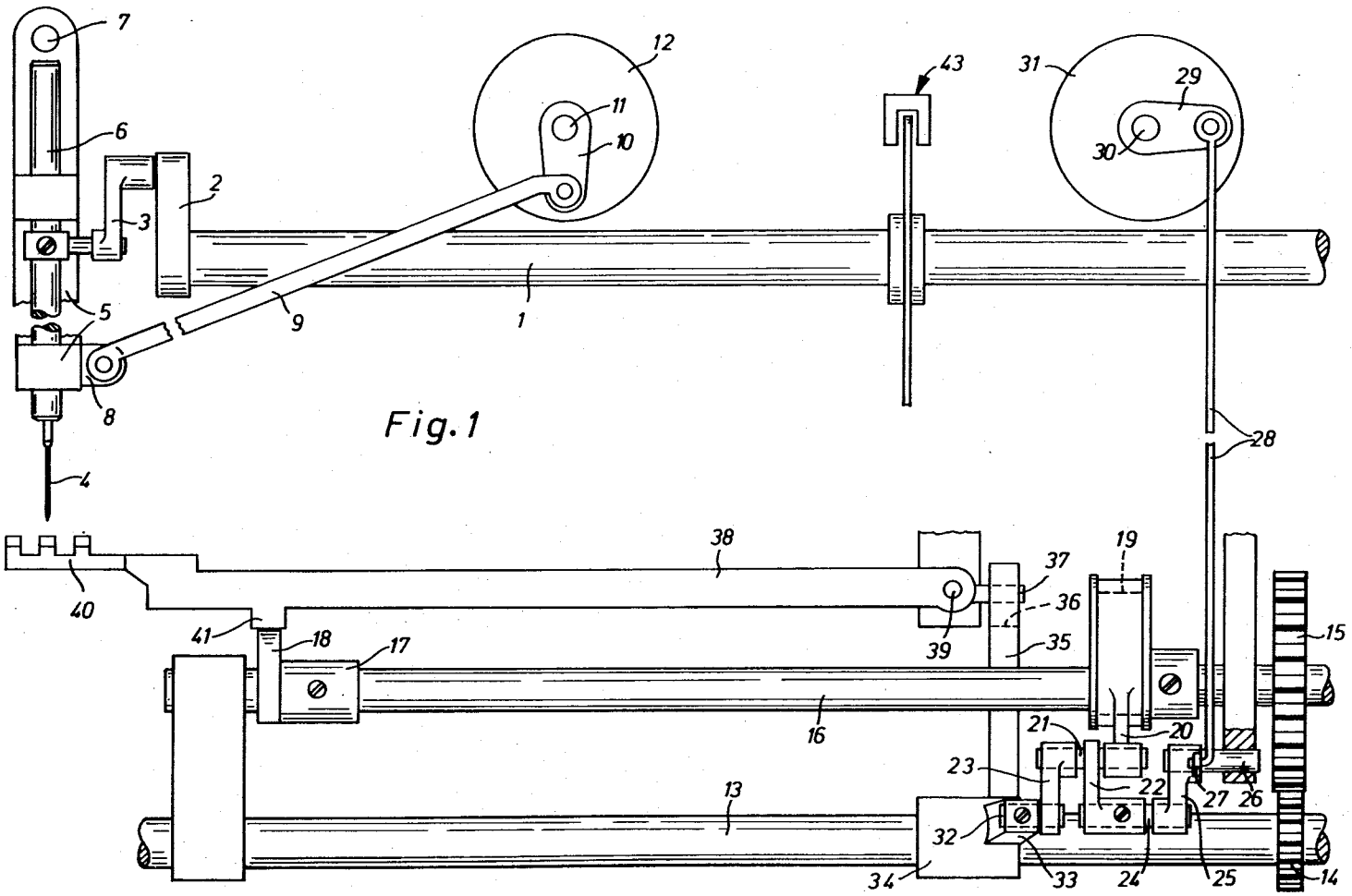
FIG. 1 is a view of the moving parts of a sewing machine, especially for the stitch length adjustment by means of a step motor.

As FIG. 1 shows, the sewing machine is equipped with a main shaft 1 which, via a crank 2 and a link 3, causes a needle bar 6 equipped with a needle 4 and mounted in a guide rocker 5 to perform vertical strokes. The guide rocker 5 is mounted by means of a trunnion 7 in the sewing machine housing (not shown).

The guide rocker 5 has a lug 8 which is connected via a link 9 to a crank 10 fastened to the shaft 11 of a step motor 12 disposed in the sewing machine housing for the control of the overstitch width of needle 4.

Via a chain (not shown), the main shaft 1 drives a lower shaft 13. Fastened to the shaft 13 is a gear 14 which meshes with a gear 15 fastened to a shaft 16 mounted parallel to shaft 13. Screwed to shaft 16 is a lifting eccentric 17 with a cam 18. Also fastened to shaft 16 is an eccentric 19, around which grips an eccentric bar 20 to which are linked by means of a bolt 21 two links 22 and 23. The link 22 is rotatably connected by a bolt 24 to an angular lever 25 which is rotatably mounted to a shaft 26 fastened in the sewing machine housing and connected via an arm 27 of the angular lever 25 and a rod 28 to a crank 29 fastened to a second step motor 31 disposed in the sewing machine housing and effecting the control of the sewing machine stitch length.

By means of a bolt 32 the link 23 is linked to an arm 33 of a rocking lever 34 mounted to the shaft 13. A second, upwardly projecting arm 35 of the rocking lever 34 has at its end a guide slot 36 in which a pin 37 is guided. The pin 37 is fastened to a carrying arm 38 movably mounted to a horizontal shaft 39 fastened in the sewing machine housing parallel to the feeding device. At its free end the carrying arm 38 supports a cloth feeder 40 provided for the transport of material to be sewn by the needle 4 in collaboration with a looper (not shown). The carrying arm 38 is supported by the cam 18 of the lifting eccentric 17 via a leg 41 pointing downwardly.

In their design and in their basic control the two step motors 12 and 31 are identical. Consequently, to understand their operating mode it suffices to describe the control of step motor 31.

Figure 2:
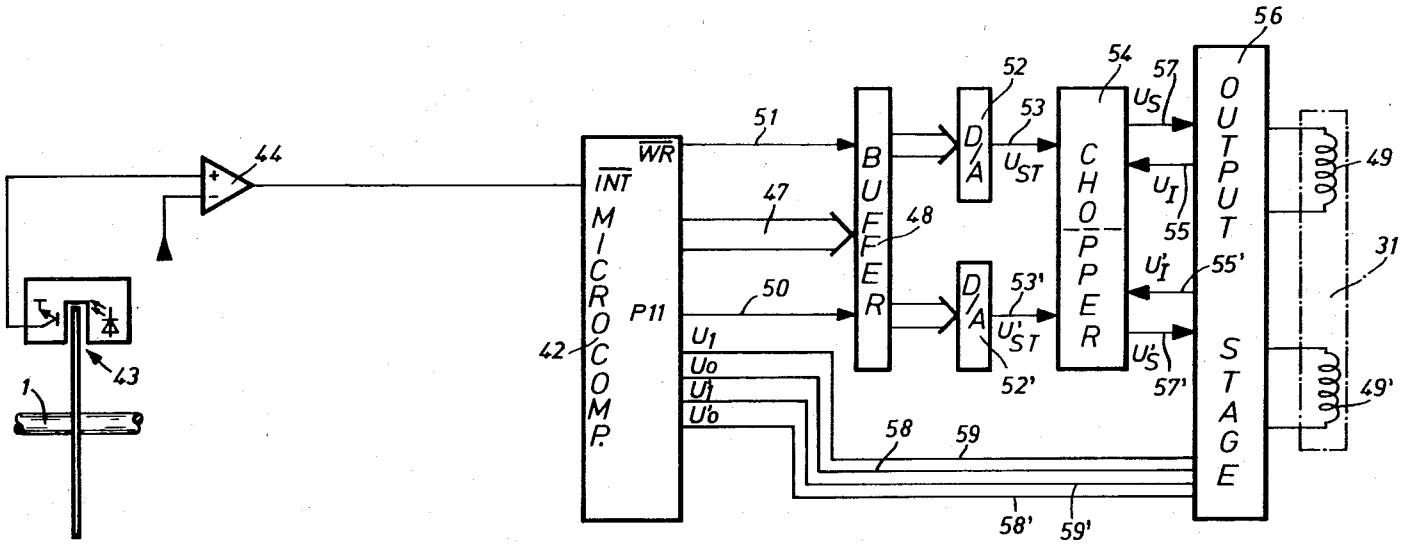
FIG. 2 is a block circuit diagram showing the step motor control.

The step motor 31, serving for the control of the sewing machine stitch length, is designed as a two-phase step motor. It is controlled by a microcomputer 42 (FIG. 2) in whose memory is stored in known manner a multiplicity of various sewing patterns.

Connected to the microcomputer 42 is a pulse generator 43 controlled by the sewing machine main shaft 1 and transmitting a pulse with every revolution of the main shaft 1 whenever the cloth feeder 40 is not in engagement with the sewing material and the step motor 31 can perform a stitch setting change. For pulse shaping the pulse is fed to a comparator 44 whose output is connected to the $\overline{\text{INT}}$ input of the microcomputer 42.

Via a group of eight data lines 47 the microcomputer 42 is connected to a buffer memory 48 for the transmission of the control processes for the two phase windings 49 and 49' present in the step motor 31 and operated with a constant current chopper control. In addition, the output P11 of the microcomputer 42 is connected to the buffer 48 through a line 50 while the output $\overline{\text{WR}}$ of the microcomputer 42 is connected to the buffer 48 through the line 51.

Since the control circuits between the buffer 48 and the phase windings 49, 49' are of identical design, only the control for the phase winding 49 will be described. Identical elements in both control circuits have been given the same reference symbols but with primes.

The buffer 48 is succeeded by a digital-to-analog converter unit 52 in which a control voltage $U_{ST}$ is generated. It is fed through a line 53 to a chopper stage 54 where it is compared with an actual voltage $U_I$ furnished through a line 55 by a step motor output stage 56. The two phase windings 49, 49' of the step motor 31 are connected to the step motor output stage 56. Also, the microcomputer 42 and the output stage 56 are interconnected by lines 58 and 59 for the transmission of switching voltages $U_0$ and $U_1$.

The buffer 48 serves the output extension of the microcomputer 42 in order to divide the half-steps normally executed by the step motor 31 once more into seven intermediate steps for balance correction.

Figure 3:
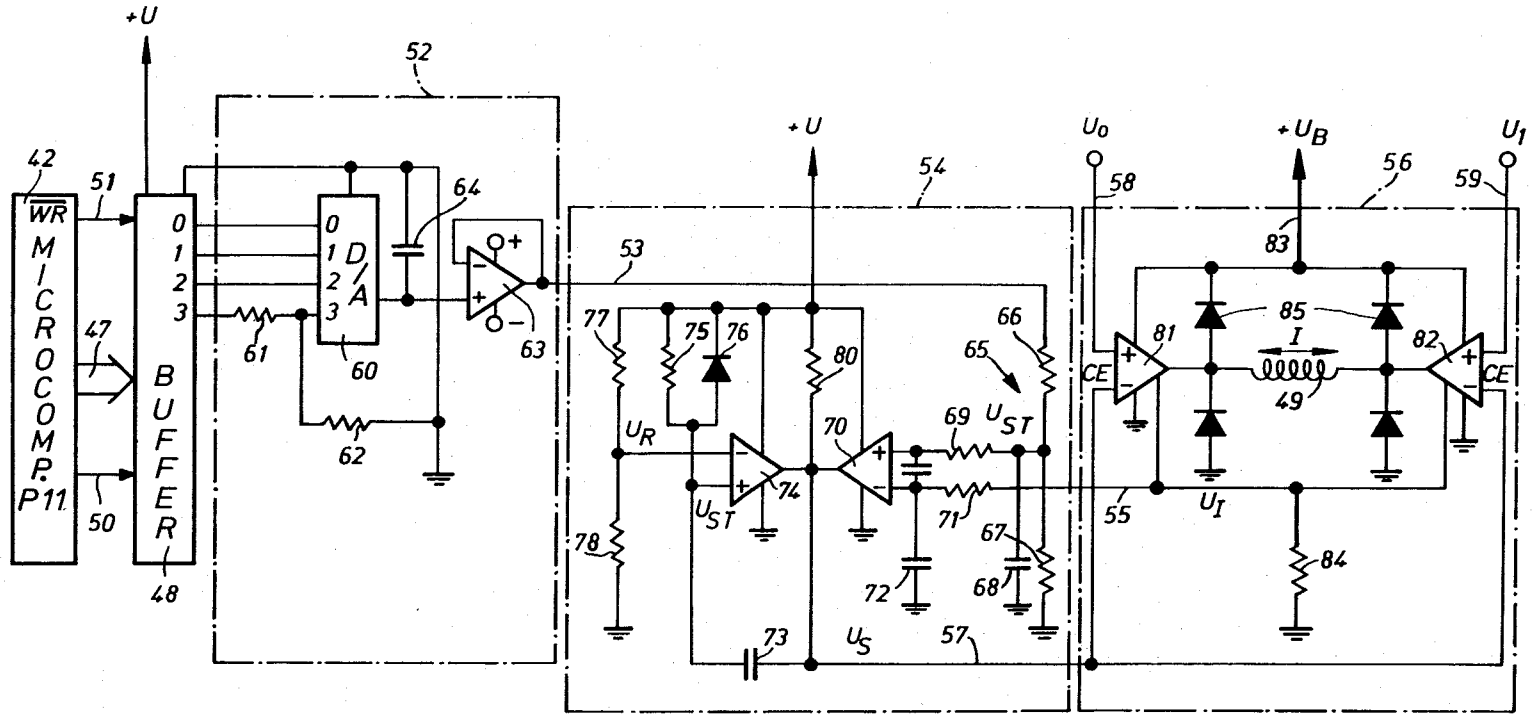
FIG. 3 is a simplified circuit diagram of the power control and of the output stage of a step motor phase circuit.

The buffer 48 (FIG. 3) has outputs 0,1,2 directly connected to inputs 0,1,2 of a D/A(digital-to-analog) converter 60 while an additional output 3 of the buffer 48 is connected via a resistor 61 to an input 3 of the D/A converter 60. The input 3 of the D/A converter 60 is grounded via a resistor 62. The output of the D/A converter 60 is connected to the non-inverting input of an impedance converter 63 and to ground via a capacitor 64.

The output of the impedance converter 63 is connected through line 53 to a voltage divider 65 consisting of resistors 66 and 67, the latter being grounded. A capacitor 68 is paralleled to the resistor 67.

The junction between the resistors 66 and 67 is connected via a resistor 69 to the reference input of a comparator 70 to whose inverting input the line 55 is connected via a resistor 71. The inverting input of the comparator 70 is grounded via a capacitor 72.

The output of the comparator 70 is connected via a capacitor 73 to the non-inverting input of a second comparator 74 and, via a resistor 75 to which a diode 76 is connected in parallel, to the positive voltage source +U. The inverting input of the comparator 74 is connected to a voltage divider consisting of the resistors 77 and 78 and inserted between the positive voltage +U and ground. The outputs of the comparators 70 and 74 are interconnected and connected to the positive voltage source +U via a resistor 80. In addition, they are connected to the step motor output stage 56 through the line 57.

In the microcomputer 42 the switching voltages $U_0$ and $U_1$ are generated which are supplied to the step motor output stage 56 through lines 58 and 59. Controlled by the microcomputer 42, the switching voltages $U_0$ and $U_1$ may assume the value L or H (that is, low or high).

The line 58 is connected to the non-inverting input of a switching amplifier 81, and the line 59 to the non-inverting input of a second switching amplifier 82 in the step motor output stage 56. The line 57 is connected to the CE inputs of both switching amplifiers 81 and 82. They operate as switches to turn on and off or reverse the phase current I for the phase winding 49 applied between the outputs of the two switching amplifiers 81 and 82.

The positive terminals of the switching amplifiers 81 and 82 are connected through a line 83 to a positive voltage source $+U_B$ and their sensor terminals through the line 55 to a precision resistor 84 which communicates with ground. Resistor 84 acts as a discriminating element for output stage 56.

The arrangement operates as follows:

When an H signal is applied to either of the non-inverting inputs of the switching amplifiers 81 and 82

(FIG. 3), their output is connected through to the positive operating voltage whereas upon the application of an L signal their output is connected through to ground. If the chip enable input (CE) carries an L signal, the output becomes highly resistant, i.e. no current flows. The CE input serve to chop or switch off amplifiers 81 and 82.

Assuming the switching voltage $U_0$ of line 58 to be H, the switching voltage $U_1$ of line 59 to be L and the switching voltage $U_S$ of line 57 also be at the L level, due to the level L of line 59, the switching amplifier 82 is grounded. The H level of line 58 causes the switching amplifier 81 to become conducting as soon as the switching voltage $U_S$ of line 57 also switches to the H potential at the CE input (see also FIG. 4 at curve *b*). In this case, therefore, the phase current I begins flowing to ground from the positive voltage source $+U_B$ via the switching amplifier 81, the phase winding 49, the switching amplifier 82 and the precision resistor 84. A voltage drop is generated at the precision resistor 84 which is fed as actual voltage $U_I$ (FIG. 4 at curve *c*) via the line 55, the resistor 71 and the capacitor 72 with time delay to the comparator 70 where it is compared with the reference voltage formed by the control voltage $U_{ST}$ in line 53. When the actual voltage $U_I$ across the precision resistor 84 exceeds the control voltage $U_{ST}$, the end of the charging phase is reached at time $t_1$. The output of comparator 70 switches the switching voltage $U_S$ to L potential (FIG. 4 at curve *b*), and the two switching amplifiers 81 and 82 are shut off via the line 57 connected to their CE inputs. At the same time, this negative voltage surge is transmitted as switching voltage $U_{S1}$ (FIG. 4 at curve *d*), through the capacitor 73 to the non-inverting input of the comparator 74, causing it to shift to L potential and keeping the switching amplifiers 81 and 82 shut off. Otherwise they would be turned on because no current is now flowing through the precision resistor 84.

Only after the capacitor 73 has been charged via the resistor 75 to the point where the switching voltage $U_{S1}$ (FIG. 4 at curve *d*) at the non-inverting input of the comparator 74 exceeds the reference voltage $U_R$ applied to the inverting input by the voltage divider (resistors 77 and 78) at the time $t_2$, the output of the comparator 74 shifts back to H potential. This causes the switching amplifier 81 to become conducting again through its CE input and the cycle described begins anew. The phase current I of the phase winding 49 is chopped, starting at time $t_1$.

In this manner, the phase winding 49 is alternately switched to a relatively high voltage and separated from it after the desired current value $I_S$ is reached so that the energy stored in the phase winding 49 is fed back to the voltage source $+U_B$ via the recovery diode 85 in accordance with the law of inductance. Therefore, the current I continues to flow in the phase winding 49.

Whole steps are the result of the simultaneous excitation of both phase windings 49 and 49' (FIG. 1). If only one of phase windings 49,49' is energized between two adjacent whole steps, a half step results.

The phase current I of the phase windings 49 and 49' can be varied by the D/A converter unit 52 to increase the torque of step motor 31 during its motion phase, to improve the holding force of the step motor 31 in a half-step position and to correct the step setting within the preset step angle.

The phase current I of the phase windings 49 and 49' changes in proportion to the control voltage $U_{ST}$. The level of the control voltage $U_{ST}$ is controlled by the microcomputer 42 (FIG. 3) in that the latter enters a correction factor into the buffer 48 through the data lines 47. In normal operation of the step motor 31 this correction factor will now remain at the output of the buffer 48 and, hence, also at the input of the D/A converter 60 until a new correction factor is put in, while the microcomputer 42, in the correction mode, applied to the buffer 48 alternately the correction factor and zero in a 1:1 ratio for reasons to be explained later.

Figure 4:
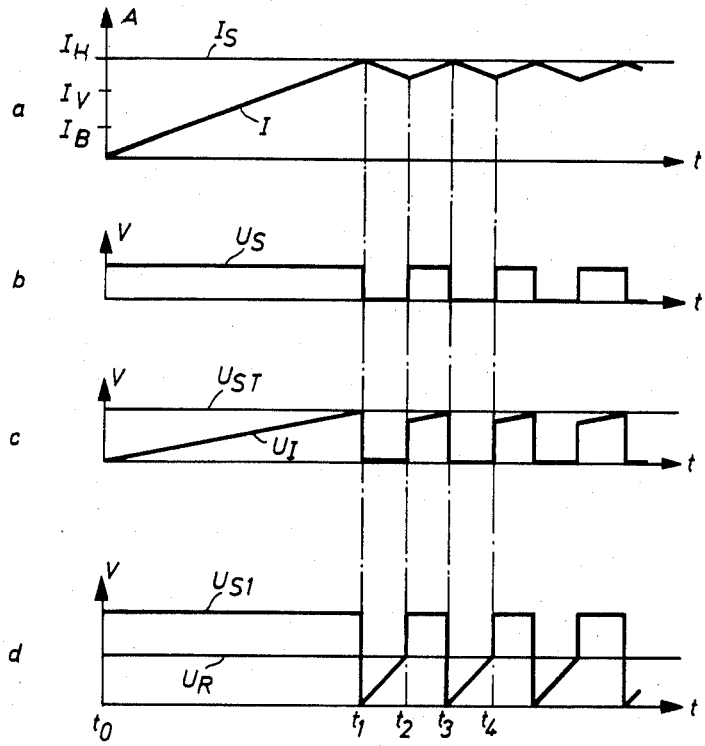
FIG. 4 shows control and level voltage curves and the phase current curve of a step motor phase winding correlated as to time.

The correction factor is converted in the D/A converter 60 into a corresponding level voltage, and the square wave voltage generated in the correction mode is filtered by the capacitor 64 so that the line 53 carries a relatively weakly pulsating control voltage. The control voltage $U_{ST}$, reduced once more and smoothed once more greatly by the capacitor 68, can now be taken off the voltage divider 65 and fed as reference voltage to the comparator 70 via the resistor 69. The level of the control voltage $U_{ST}$ determines the rise time and, hence, the level of the phase current I (FIG. 4).

Figure 5:
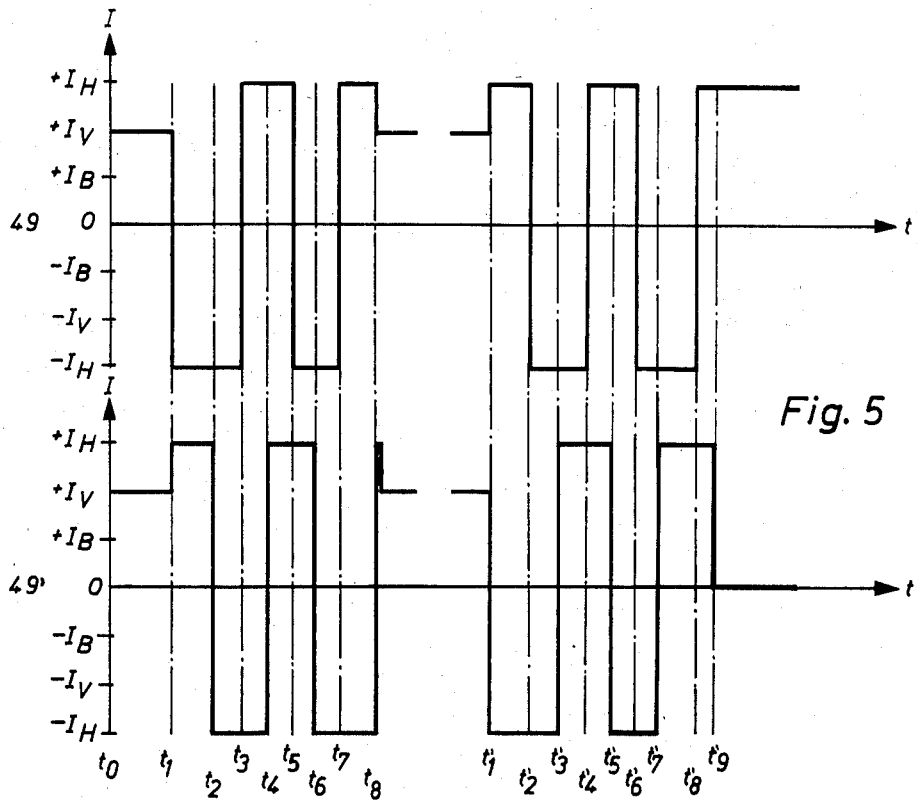
FIG. 5 shows phase current curves of both step motor phase windings when executing full and half steps while being driven as well as in a full and a half-step holding position correlated as to time.

Predetermined, constant current values are assigned to the phase current I through suitable circuitry. In accordance with the correction factor applied to the buffer 48, the level of the phase current I is controlled to a current value $+I_H$, $-I_H$, $+I_V$, $-I_V$ or to a current value between $-I_B$ and $-I_B$ (FIGS. 5 and 6). A positive sign indicates that the phase current I flows in one direction, a negative sign in the other direction determined by the control voltages $U_0$ and $U_1$. If the control voltage $U_0$ and $U_1$ are the same, no current flows through the respective phase winding 49 or 49'.

FIG. 5 shows the current curve in the two phase windings 49 and 49' of the step motor 31 when executing eight whole steps in one direction and, after a pause, eight whole steps and one half step in the other direction. FIG. 5*a* indicates the curve of the phase current I in the phase winding 49 and FIG. 5*b* in the phase winding 49'.

At time $t_0$ the step motor 31 is in whole step position because phase currents I of the current value $+I_V$ flow through both phase windings 49 and 49'. In this whole step position the inputs 0,1 and 2 of the D/A converters 60 of both phase windings each carry H potential. Since both phase currents I are of the current value $+I_V$, the holding moment is great enough.

At time $t_1$ the step sequence starts. The current flow in the phase winding 49' is increased to the current value $+I_H$ while the current flow in the phase winding 49 is reversed by the reversal of the control voltages $U_0$ and $U_1$ and increased to the current value $-I_H$. This generates a higher torque to drive the step motor 31 in that the microcomputer 42 also applied H potential to the input 3 of the D/A converters 60 in addition to the inputs 0 through 2.

At time $t_2$ the current flow and the current value $-I_H$ in the phase winding 49 is maintained while the current flow in the phase winding 49' is reversed to the current value $-I_H$. The step motor 31 is thus driven until, upon reaching the desired whole step position at time $t_8$, the phase currents I of both phase windings 49 and 49' are reduced to the current value $+I_V$.

For the step motor 31 to execute a revolution in the opposite direction, the phase current I of the phase winding 49 is increased to the current value $+I_H$ at time $t''_1$ while the current flow in the phase winding 49' is reversed and increased to the current value $-I_H$. At time $t'_2$ the phase current I of the phase winding 49, having the current value $+I_H$, is reversed whereas the phase current I of the phase winding 49' is maintained, etc. At time $t'_9$, i.e. at the end of the second step sequence, the step motor 31 is in half step position in which the phase current I of the one phase winding, in this case the phase winding 49, is zero. The phase current I of the other phase winding 49 is, therefore, kept at its increased current value $+I_H$ in order to increase accordingly the holding force of the step motor 31, normally decreased in this position.

In FIG. 6 is shown the controlled correction between two whole step positions VS. The step setting between a whole step VS and the adjacent half step HS is corrected by dividing the step angle between them into seven intermediate steps. Since the step motor 31 in its intended operation works very much in its magnetic saturation, its angular deviation is no longer proportional to the current change. The result of measurements has been that proportionality of angular rotation and current change occurs in the present case only below half of the current value $+I_V$ of $-I_V$ of the phase current I, i.e. below $+I_B$ of $-I_B$. Therefore, to execute a step correction in seven uniform stages, the current stage of the phase current $+I_V$ of $-I_V$, preset by the microcomputer 42, is always cut in half. This is done by the already mentioned chopping of the correction factor at the outputs 0 through 2 of the buffer 48 by the microcomputer 42 (FIG. 3) in the pulse time to pause time ratio of 1:1. During the pulse time the buffer 48 contains the correction factor and during the pause time zero. After appropriate filtering by the capacitor 64 as well as the resistor 66 and the capacitor 68 the generated control voltage $U_{ST}$ is only of half the previous value.

If all inputs 0 through 3 of the D/A converter 60 of the one phase winding 49 or 49' carry L potential, making the correction factor zero while at the other phase winding 49 or 49' the correction value at the inputs 0 through 3 is of constant H potential, the step motor 31 adjusts to a half step HS. As FIG. 6 (position HS) shows, the phase current I of the one winding 49 is then zero and that of the other winding 49' is $+I_H$, for example. The step motor 31 thereby changes its angle of rotation so as to adjust to the position HS in the middle between the two whole steps VS.

In the case of the whole step VS all inputs 0 through 2 of the D/A converters 60 of both phase windings 49 and 49' are switched to H potential. But when all inputs 0 through 3 of the one D/A converter is switched to L potential and all inputs 0 through 3 of the other D/A convertor 60 to H potential, a half step HS is present.

When a certain correction factor, chopped 1:1, is applied by the microcomputer 42 to the buffer 48 of the phase winding 49, e.g. H potential at the outputs 0 and 2 and L potential at the outputs 1 and 3 at positive phase current I and retention of the value $+I_V$ in the phase winding 49', the step motor 31 adjusts to the correction position of the angle of rotation $\rho$ as shown in FIG. 6 by the identification 5. The same applies analogously to the adjustment into other correction positions.

If the step motor is to be stopped in a half step position HS, the input 3 of the D/A converter 60, whose inputs carry H potential in this case, stays on H potential in order to increase the holding amount of the step motor 31 which is lower in this position. To avoid too great an increase of the phase current I which would result from a current doubling, the voltage divider consisting of the resistors 61 and 62 is inserted so that the control voltage $U_{ST}$ is not doubled, but increased only by half the amount. This causes the phase current I of the respectively energized phase winding 49 or 49' to increase in the half step position HS from the current value $+I_V$ or $-I_V$ to the current value $+I_H$ or $-I_H$, which still results in no heating problems in a permanent holding position of the step motor 31 in this position.

While a specific embodiment of the invention has been shown and described in detail to illustrate the application of the principles of the invention, it will be understood that the invention may be embodied otherwise without departing from such principles.

What is claimed is:

1. In a sewing machine having a main shaft, a needle bar operatively connected to the main shaft for moving the needle bar to execute a sewing motion, a cloth feeder movable to feed a cloth and position changing means operatively connected to one of the needle bar and cloth feeder for controlling the motion thereof to form a selected stitch pattern, the position changing means including a step motor having a shaft and a pair of phase windings for controlling a rotational position of the step motor shaft from a normal position, the improvement comprising:

a pulse generator operatively connected to the main shaft for generating pulses with rotation of the main shaft;

a microcomputer connected to said pulse generator for processing digital information corresponding to a selected stitch and for receiving pulses from said pulse generator;

a buffer memory having an input for receiving digital information from said microcomputer and an output;

a digital-to-analog converter connected to said buffer memory output for converting digital data from said buffer memory into an analog signal corresponding to a position deviating from the normal step motor shaft position;

a step motor phase control circuit for generating a phase current to be applied to each of said phase windings, said phase control circuit having a discriminating element for providing a precision pathway for the phase current;

a first comparator having an inverting input connected to said discriminating element for receiving a control signal, a non-inverting input connected to said digital-to-analog converter for receiving said analog signal and an output connected to said phase control circuit for controlling the turning-on and turning-off as well as the intensity of said phase current in response to a comparison between said analog signal and said control signal; and a second comparator having an output connected to said output of said first comparator, an inverting input connected to a reference voltage and a non-inverting input connected via a resistor to said reference voltage and via a condenser to said outputs of said first and second comparators.

2. In a sewing machine according to claim 1, the improvement comprising said digital-to-analog converter having a four bit input connected to said buffer memory with a most significant bit and a least significant bit, and a voltage divider connected between said buffer memory and said digital-to-analog converter at said most significant bit.

3. In a sewing machine according to claim 1, the improvement wherein said step motor phase control circuit includes a first switching amplifier and a second switching amplifier, said first and second switching amplifiers each having an output connected to opposite ends of a current carrier for carrying said phase current, each of said first and second switching amplifiers having a non-inverting input connected to said microcomputer for receiving a control signal and an inverting input connected to said comparator output for receiving a chopping signal for chopping said phase current to zero, each of said first and second switching amplifiers having a voltage receiving input and a voltage supplying input, each voltage supplying input connected to said discriminating element and to said inverting input of said comparator for supplying said control signal.

4. A sewing machine with a main shaft, a vertically guided needle bar in driving connection with the main shaft for a lifting motion of the needle bar, a step motor with a plurality of phase windings controlled by a microcomputer connected to setting means for the control of the size and direction of the feeding action of a cloth feeder, and a pulse generator connected to the main shaft and triggering the step motor motion, comprising: the microcomputer (42) being connected, via a buffer memory (48) and D/A converter (60), to the non-inverting input of a first comparator (70) which controls the turning on and off as well as the intensity of a phase current (1) of each phase winding (49,49') of the step motor (31) and whose inverting input is connected to a discriminating element (84) disposed in a phase circuit (56) of the step motor, said first comparator having an output connected to said phase circuit for controlling the turning on and off as well as the intensity of the phase current of each phase winding, a second comparator (74) having an output connected to said output of said first comparator, an inverting input connected to a reference voltage ($U_R$) and a non-inverting input connected via a resistor (75) to said reference voltage and via a condenser (73) to said outputs of said first and second comparators.

5. A sewing machine according to claim 4, wherein the D/A converter (60) has four input stages (0 through 3) whose biggest stage (3) is connected to the corresponding outputs of the buffer memory (48) via a voltage divider (61,62).

* * * * *